US008641029B2

(12) United States Patent
Spatz et al.

(10) Patent No.: US 8,641,029 B2
(45) Date of Patent: Feb. 4, 2014

(54) METHOD AND DEVICE FOR PROCESSING PRINTED PRODUCTS MADE OF MULTIPLE PAPER SHEETS AS WELL AS A PERFORATING KNIFE

(75) Inventors: Urban Spatz, Neusaess (DE); Robert Heuberger, Neusaess (DE)

(73) Assignee: manroland AG, Offenbach/Main (DE)

( * ) Notice: Subject to any disclaimer, the term of this patent is extended or adjusted under 35 U.S.C. 154(b) by 0 days.

(21) Appl. No.: 12/968,959

(22) Filed: Dec. 15, 2010

(65) Prior Publication Data

US 2011/0140340 A1 Jun. 16, 2011

(30) Foreign Application Priority Data

Dec. 16, 2009 (DE) ..... 10 2009 054 766

(51) Int. Cl.
*B41F 13/54* (2006.01)

(52) U.S. Cl.
USPC ..... 270/52.09; 270/21.1; 270/5.03

(58) Field of Classification Search
USPC ..... 270/5.01, 5.02, 5.03, 21.1, 52.09
See application file for complete search history.

(56) References Cited

U.S. PATENT DOCUMENTS

| | | | | |
|---|---|---|---|---|
| 2,115,392 | A | 4/1938 | Mabon | |
| 3,107,929 | A | 10/1963 | Bohmert | |
| 4,974,822 | A * | 12/1990 | Richter | 270/48 |
| 5,072,919 | A * | 12/1991 | Schneider et al. | 270/49 |
| 5,186,444 | A * | 2/1993 | Palmatier et al. | 270/52.09 |
| 6,454,692 | B2 | 9/2002 | Ganneval et al. | |
| 6,616,134 | B2 * | 9/2003 | Maresse et al. | 270/52.09 |
| 6,651,539 | B1 * | 11/2003 | Eicher et al. | 83/698.42 |
| 7,311,651 | B2 * | 12/2007 | Stab | 493/428 |

FOREIGN PATENT DOCUMENTS

| | | | |
|---|---|---|---|
| DE | 20 31 541 | A1 | 1/1972 |
| DE | 10 2004 011898 | A1 | 9/2005 |
| WO | WO 00/10899 | A1 | 3/2000 |
| WO | WO 03/074400 | A1 | 9/2003 |
| WO | WO 03/074401 | A1 | 9/2003 |

OTHER PUBLICATIONS

European Search Report, dated Mar. 25, 2011, 7 pages.
Canadian Office Action dated Aug. 20, 2012 (three (3) pages).

* cited by examiner

*Primary Examiner* — Patrick Mackey
(74) *Attorney, Agent, or Firm* — Crowell & Moring LLP

(57) ABSTRACT

A method and device for processing printed products made of multiple paper sheets is disclosed. The paper sheets are moved in the direction of a leading open edge and the paper sheets are connected to each other in a detachable manner in the region of the edge.

4 Claims, 2 Drawing Sheets

METHOD AND DEVICE FOR PROCESSING PRINTED PRODUCTS MADE OF MULTIPLE PAPER SHEETS AS WELL AS A PERFORATING KNIFE

This application claims the priority of German Patent Document No. 10 2009 054 766.5, filed Dec. 16, 2009, the disclosure of which is expressly incorporated by reference herein.

BACKGROUND AND SUMMARY OF THE INVENTION

The invention relates to a method and a device for processing printed products made of multiple paper sheets as well as a perforating knife.

Printed products which have only a longitudinal fold, but not a cross fold, are generally known. After printing a paper web in a web-fed printing press, these printed products are guided via a former, provided there with the longitudinal fold, and then severed from the folded ribbon formed in the process by a cutting knife cylinder, i.e., detached. Since these printed products and the leading cut edge formed in the process are open, it is possible for the individual pages to fan out. Especially during the further transport of the printed products, this may result in tears, dog-earing, i.e., corners of pages being turned down, or other damage.

Starting herefrom, the object of the invention is creating a method and a device which prevents damage to the printed products from the fanning out of individual pages.

Because of the inventive positive connection of the paper sheets of a printed product in the region of an open, i.e., unfolded, edge, the printed product may be moved forward with this product edge without the individual pages fanning out. In particular, when further transporting the printed products to additional processing stations, tears, dog-earing or other damage is advantageously prevented.

The invention is especially advantageous in the case of folding units which apply only a longitudinal fold to the printed products and where the printed products are moved further with their open, i.e., unfolded, side pointing forward.

The invention is explained in greater detail in the following on the basis of the associated schematic drawings.

DETAILED DESCRIPTION OF THE DRAWINGS

Figure 1:
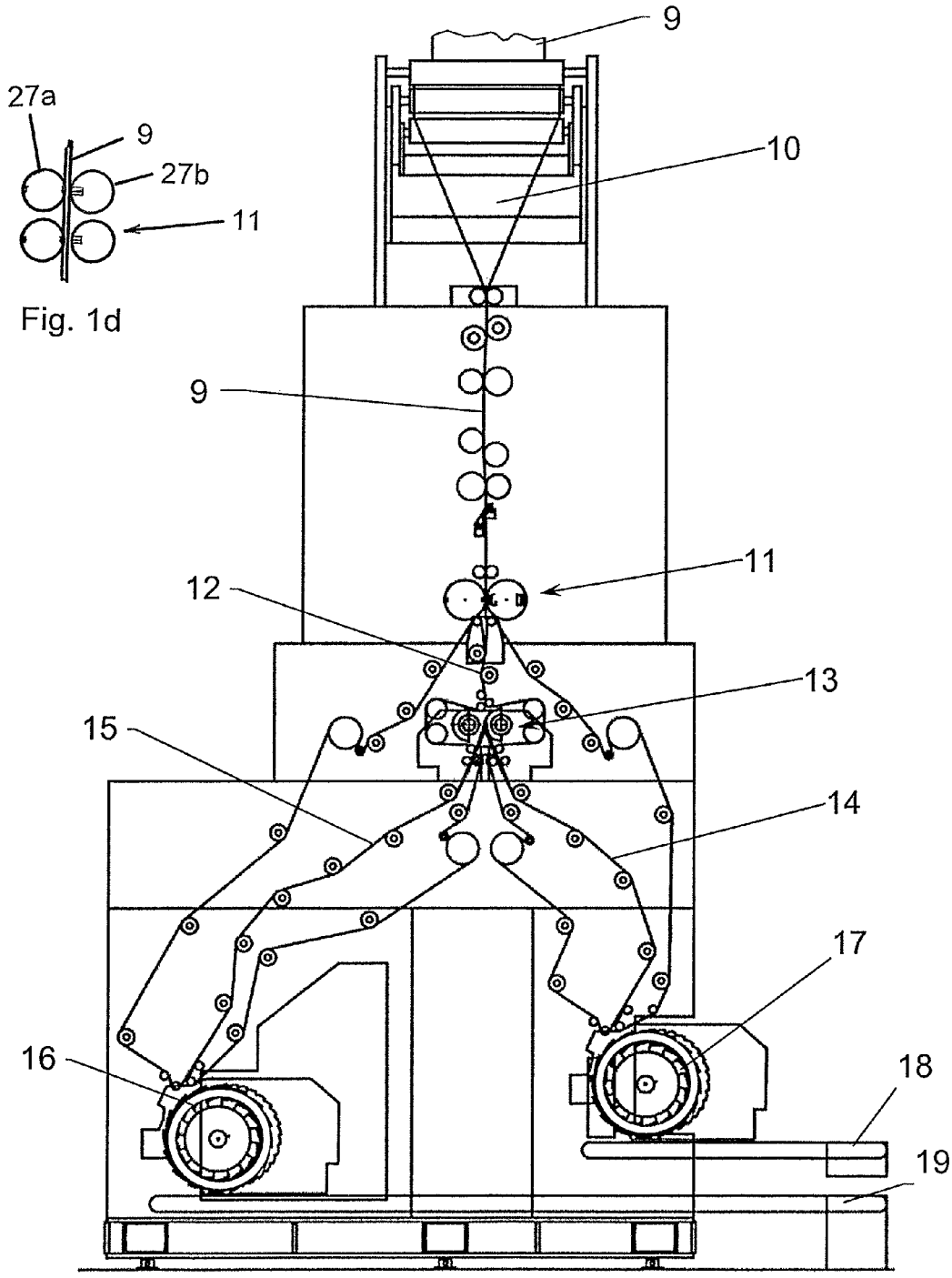
FIG. 1 shows an example of a former folding unit having a device according to the invention.
Figure 1A:
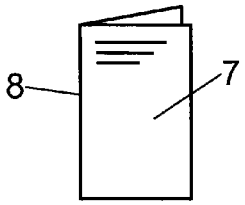
FIGS. 1*a, b*, and *c* show examples of printed products which can be produced with a folding unit according to FIG. 1.
Figure 1B:
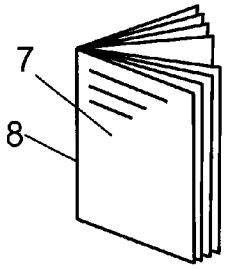
FIG. 1*d* shows an example in which perforating and severing of individual printed products are carried out in separate operations.
Figure 1C:
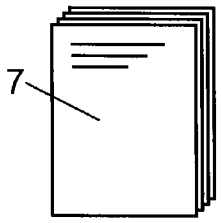

FIG. 1 depicts an example of a former folding unit having a former 10, via which the paper web 9 printed by a printing press is guided and provided with a longitudinal fold 8 (see FIGS. 1*a, b*). In this connection, the paper web 9 may be an individual (partial) web, which after longitudinal folding and separation produces a product according to FIG. 1*a* or it may be multiple stacked (partial) webs, which after longitudinal folding and separation produce a product according to FIG. 1*b*, where several folded sheets are inside one another. It is also conceivable for the individual or the multiple (partial) webs to be cut longitudinally in the folding plane and to be placed on top of one another by guidance via the former. This produces a product as depicted in FIG. 1*c*, i.e., individual loose sheets stacked on top of one another.

The longitudinally folded paper web 9 is guided after the former 10 via draw roller and/or guide roller groups to a cutting unit 11, where individual printed products are severed in accordance with FIGS. 1*a, b* or *c*. These printed products are conveyed via a first conveyor belt 12 to a so-called splitter 13, which feeds the consecutive printed products in an alternating manner to a right conveyor belt 14 and to a left conveyor belt 15. The entire product stream is thereby divided into two partial streams. The left conveyor belt 15 leads to a first fan wheel 16, which delivers the printed products on a first product delivery 19 and the right conveyor belt 14 leads to another fan wheel 17, which delivers the printed products on another product delivery 18.

Figure 2:
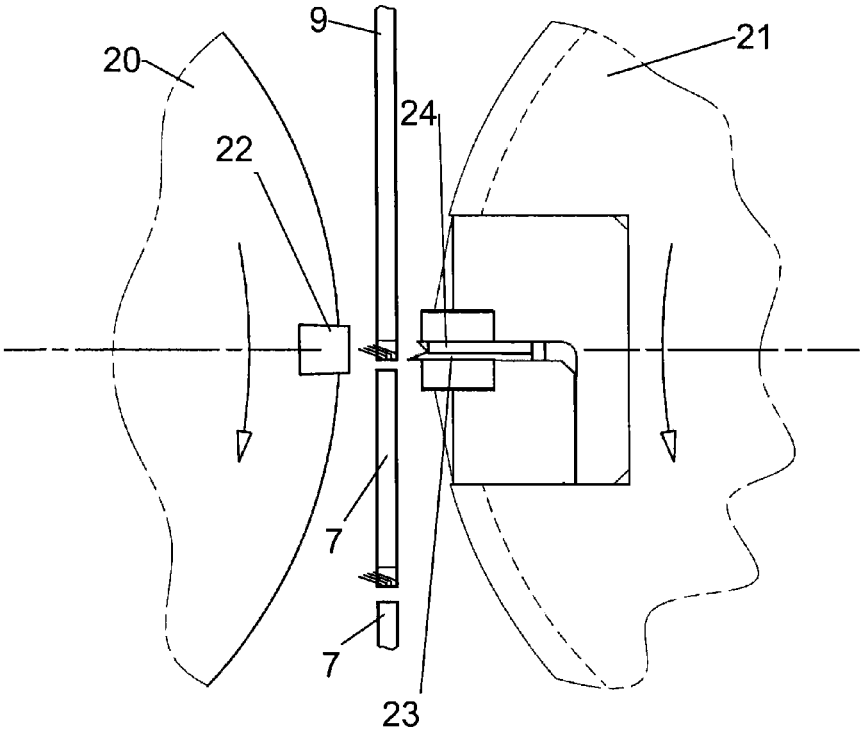
FIG. 2 depicts an enlarged section of the cutting group from FIG. 1.

FIG. 2 shows an enlargement of the cutting unit 11 from FIG. 1. A cutting cylinder 21 can be seen on the right side, on which a cutting knife 23 is arranged and whose purpose is to sever individual printed products 7 from the paper web 9. A perforating knife 24 is provided directly adjacent to this cutting knife 23. The cutting knife 23 and the perforating knife 24 cooperate with a cutting strip 22, which is arranged on an opposing cutting cylinder 20 opposite from the cutting cylinder 21. The arrows marked on the cylinders 20, 21 indicate the direction of rotation of the cutting unit 11.

When a printed product 7 is severed, the cutting knife 23 pierces the paper web 9 over its entire width and sinks into the cutting strip 22, which is preferably made of a cutting rubber. According to its arrangement on the trailing side of the cutting knife 23 (as viewed in the rotational direction of the cutting cylinder 21), the perforating knife 24 pierces the paper web 9 at a slightly later point in time, however, only in a punctiform manner with its perforating tips 25 (FIG. 3).

Figure 3:
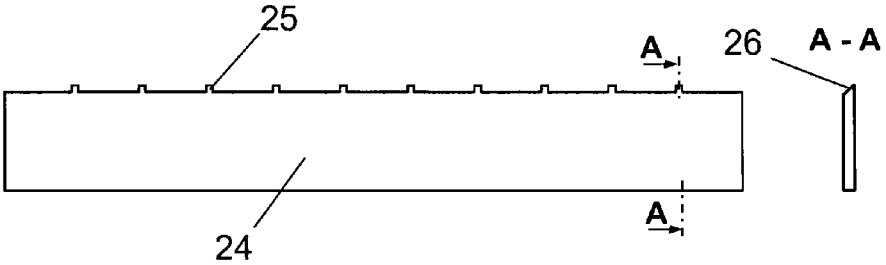
FIG. 3 shows the front and side views of a perforating knife.

FIG. 3 shows an example of a perforating knife 24, which is provided with projecting, perforating tips 25 arranged at a distance from one another. As a result of the perforating, i.e., the punctiform piercing of all paper sheets of the printed product, the sheets are positively connected to one another.

How the individual paper sheets are pressed out of the plane of the paper web by the perforating knife 24 in a punctiform manner thereby producing a connection between the paper sheets is shown schematically at the end of the paper web 9 and on the severed printed product 7 (FIG. 2).

The paper sheets that are perforated together can be pulled apart easily, i.e., the connection is detachable. Likewise the region containing the perforation may be removed by a cut at the end of processing the printed products 7.

Because the trailing side of the cutting knife 23 on which the perforating knife 24 is arranged creates the leading edge of the successive printed product when a printed product 7 is severed, the individual paper sheets of the printed products 7 are respectively connected to one another on their leading edge.

The perforating tips 25 are preferably provided with a bevel 26, which is evident from the sectional representation A-A. The perforating knife 24 is preferably arranged in such a way next to the cutting knife that the bevel 26 points towards the cutting knife 23. This advantageously prevents the printed product from getting hooked and damaged on the perforating knife 24 after cutting and perforating.

The number of perforating tips 25 and the distance of the perforating tips 25 from one another are selected according to how strong the connection is supposed to be. The greater the number of perforating tips and/or the closer the perforating tips 25 are arranged next to one another, the greater the strength of the connection.

Similarly, the location of the connection can be defined by the arrangement of the perforating tips 25, e.g., near another open edge of the printed product 7.

The cutting cylinder 21 and the opposing cutting cylinder 20 of the cutting unit 11 depicted in FIGS. 1 and 2 are preferably provided on their circumference respectively with two cutting strips or perforating knives as well as opposing cutting strips. However, depending on the cut-off length of the printed products, it is also conceivable to provide three or more systems on the circumference.

Thus, with the present invention, all paper sheets of a printed product are connected to each other in a detachable manner on an open side, i.e., on an unfolded edge. This makes it possible to advantageously prevent the individual pages from fanning out and getting damaged when the printed product is moved forward with this edge.

To this end, in addition to the perforating knife provided in the exemplary embodiment described at the outset, alternatively pins, as they are generally known from folding units, may also be arranged, which pierce the paper sheets of the printed product in a punctiform manner and thereby positively connect the paper sheets.

In addition, it is also conceivable to carry out the perforating or needling and the severing of the individual printed products from the paper web in separate operations. For this purpose, as shown in the exemplary embodiment according to FIG. 1*d*, a pair of perforating cylinders 27*a*, 27*b* may be arranged in the region between the former 10 and the cutting unit 11, which in this case is equipped only with cutting knives.

In addition, it may also be advantageous to perforate or needle at a short distance from the product edge/cut edge in order to prevent a formation of paper snippets. For this purpose, a spacer could be placed between the cutting knife 23 and the perforating knife 24 of the exemplary embodiment according to FIGS. 1-3. If the perforating takes place in a separate work step, the perforating unit of the cutting unit must only lag.

As an alternative to perforating or needling, i.e., piercing the paper sheets, it is also possible to carry out a stamping on the paper sheets on the edge of the printed product. As a result of the associated pressing on of a contour, material displacement produces relief-like, raised locations or impressions, which connect the individual paper sheets to each other.

To this end, knobs, i.e., elevations, can be provided, for example, on the trailing side of the cutting knife, which deform the paper sheets in a punctiform manner during the cutting process.

LIST OF REFERENCE NUMBERS

7 Printed product
8 Longitudinal fold
9 Paper web
10 Former
11 Cutting unit
12 Conveyor belt
13 Splitter
14 Conveyor belt
15 Conveyor belt
16 Fan wheel
17 Fan wheel
18 Product delivery
19 Product delivery
20 Opposing cutting cylinder
21 Cutting cylinder
22 Cutting strip
23 Cutting knife
24 Perforating knife
25 Perforating tip
26 Bevel
27*a, b* Perforating cylinders The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for processing a printed product made of multiple paper sheets in a direction of one pair of opposed cutting cylinders, comprising the steps of:

severing the multiple paper sheets into individual products by way of at least one cutting knife located on one of said cutting cylinders; and connecting the individual products to each other in a region of individual product leading edges by piercing the multiple paper sheets with at least one continuous perforating knife, the at least one continuous perforating knife having multiple perforating tips arranged at certain distances from one another along an edge of the at least one continuous perforating knife;

wherein the at least one cutting knife is disposed on the cutting cylinder adjacent to the perforating knife.

2. The method according to claim 1, wherein the perforating tips include bevels pointing toward the at least one cutting knife.

3. A method according to claim 1, further comprising supplying the multiple paper sheets via roller groups to the opposed cutting cylinders.

4. The method according to claim 1, wherein the at least one continuous perforating knife has a length that is roughly the same as a maximum width of the multiple paper sheets.

* * * * *